US006612822B2

(12) United States Patent
Buschur et al.

(10) Patent No.: US 6,612,822 B2
(45) Date of Patent: Sep. 2, 2003

(54) HYDRAULIC MOTOR SYSTEM

(75) Inventors: Jeffrey J. Buschur, Lake Orion, MI (US); John S. Hill, Dayton, OH (US); Michael Mientus, Metamora, IL (US)

(73) Assignee: Valeo Electrical Systems, Inc., Auburn Hills, MI (US)

( * ) Notice: Subject to any disclaimer, the term of this patent is extended or adjusted under 35 U.S.C. 154(b) by 0 days.

(21) Appl. No.: 09/900,928

(22) Filed: Jul. 9, 2001

(65) Prior Publication Data

US 2003/0005906 A1 Jan. 9, 2003

(51) Int. Cl.[7] ..... F04C 18/00

(52) U.S. Cl. ..... 418/171; 418/200; 418/149; 418/21; 277/365

(58) Field of Search ..... 418/171, 200, 418/1, 149, 21; 277/365

(56) References Cited

U.S. PATENT DOCUMENTS

| | | | | |
|---|---|---|---|---|
| 2,876,947 A | * | 3/1959 | Butler | 418/9 |
| 3,240,158 A | * | 3/1966 | Brundage | 277/365 |
| 3,244,111 A | | 4/1966 | Shelhart | |
| 3,272,130 A | * | 9/1966 | Mosbacher | 418/171 |
| 3,421,389 A | | 1/1969 | Fauchere | |
| 3,435,616 A | | 4/1969 | Waldorff | |
| 3,551,081 A | | 12/1970 | Brundage | |
| 3,687,578 A | * | 8/1972 | White et al. | 418/21 |
| 3,757,524 A | | 9/1973 | Poyner et al. | |
| 4,098,083 A | | 7/1978 | Carman | |
| 4,179,888 A | | 12/1979 | Goscenski, Jr. | |
| 4,411,606 A | * | 10/1983 | Miller | 418/186 |
| 4,519,755 A | * | 5/1985 | Hanson | 418/171 |
| 4,711,090 A | | 12/1987 | Hartiala et al. | |
| 4,799,851 A | | 1/1989 | Swanson | |
| 5,199,525 A | | 4/1993 | Schueler | |
| 5,216,983 A | * | 6/1993 | Nilson | 123/41.12 |
| 5,347,812 A | | 9/1994 | Nilsson et al. | |
| 5,535,845 A | | 7/1996 | Buschur | |
| 5,561,978 A | | 10/1996 | Buschur | |
| 5,669,461 A | | 9/1997 | Buschur | |
| 5,687,568 A | | 11/1997 | Buschur | |
| 5,778,693 A | | 7/1998 | Mientus | |
| 5,881,630 A | | 3/1999 | Buschur | |
| 5,960,628 A | | 10/1999 | Machesney et al. | |
| 6,016,657 A | | 1/2000 | Buschur | |
| 6,021,641 A | | 2/2000 | Buschur | |
| 6,158,216 A | | 12/2000 | Buschur | |
| 6,195,990 B1 | * | 3/2001 | Machesney et al. | 418/171 |

FOREIGN PATENT DOCUMENTS

| | | | | |
|---|---|---|---|---|
| DE | 2729208 A | * | 5/1979 | F01C/1/10 |
| DE | 3626013 CI | | 9/1987 | |
| GB | 1579928 A | * | 11/1980 | F01C/1/10 |
| JP | 07247964 | | 9/1995 | |
| JP | 09025882 | | 1/1997 | |

OTHER PUBLICATIONS

Nichols, The Gerotor Information Packet, pp. 1–4 and 6–7.

"Hydraulic Powered Steering & Cooling System With Energy Savings Circuit" (research disclosure), No. 369, Jul. 1994, Great Britain.

* cited by examiner

*Primary Examiner*—Thomas Denion
*Assistant Examiner*—Theresa Trieu
(74) *Attorney, Agent, or Firm*—Jacox Meckstroth & Jenkins

(57) ABSTRACT

An improved hydraulic motor system, suitable for driving an automotive cooling fan or the like. The system is driven by grade gerotor set and an idle gerotor set which are stacked between a center plate and against a rear wall of a cylindrical cavity in a front face of a manifold. A fluid-tight chamber is established by securing an end frame can around the stacked gerotor sets and against the perimeter of the manifold cavity. Tightness of the seal is controlled by positioning a resilient cover plate against the end frame can from a position opposite the manifold, and adjustably clamping the resilient cover against the manifold until the resilient cover has undergone a predetermined amount of elastic deformation.

14 Claims, 8 Drawing Sheets

HYDRAULIC MOTOR SYSTEM

BACKGROUND OF THE INVENTION

This invention relates to an arrangement of cooperatively driven hydraulic motors for use in powering an automotive cooling fan or the like. Automotive engines are typically supplied with a liquid coolant, which is circulated through a radiator. The radiator is a heat exchanging device which collects heat generated by an internal combustion process and radiates it to the ambient air. Under ideal conditions, the heat transfer would proceed at the rate at which it is generated. Unfortunately, this is easier said than done.

When an automotive engine is idling, there is no natural airflow across the radiator surfaces, and it is customary to supplement the airflow with forced air from a cooling fan. As an automotive vehicle moves forward from an idle condition and gains speed, it suffers gradually increasing energy losses from air drag, road friction and internal frictional losses. These energy losses are made up by increasing the rate of internal combustion. That in turn increases the rate of heat generation, thereby increasing the work which must be done by the radiator. However, increases in vehicle speed cause an increase in the natural airflow through the radiator. This increase in natural airflow increases natural cooling at a rate which rises faster than the rate of heat generation. As a consequence, the workload on the cooling fan generally decreases with vehicle speed.

The above energy considerations are discussed in detail in Buschur U.S. Pat. No. 5,561,978. That patent teaches that improved energy efficiency may be achieved by providing an automotive cooling system having a plurality of hydraulic motors which are switched into driving relationship with the cooling fan in response to pressure conditions in the hydraulic fluid supply. By way of example, the Buschur patent teaches a hydraulic motor system comprising two segregated spur gear hydraulic motors, communicating with a hydraulic fluid supply and driving a common fan shaft. It is taught that the fluid supply lines may be connected either in parallel or in series and that one or more clutches may be provided for selectively placing the hydraulic motors into driving relationship with the fan shaft. The patent also suggests the use of gerotor type hydraulic motors.

FIG. 1 hereof illustrates a prior art hydraulic motor drive 300 for an automotive cooling fan (not illustrated). The drive unit 300 comprises a first hydraulic motor 302 and a second hydraulic motor 304, both of which are of the gerotor type. Hydraulic motors 302, 304 are supported by a manifold body 306 and are sealed against opposite faces of a coupling block 308. The assembly is secured to manifold body 306 by four bolts 309*a*–309*d* and an end plate 310. It is readily apparent that motor system 300 is quite complex, difficult to assemble and susceptible to fluid leakage at approximately a dozen seals to atmosphere. There is a need for an improved dual displacement hydraulic motor system which is more simple to manufacture and easier to maintain.

SUMMARY OF THE INVENTION

This invention provides an improved motor system, suitable for driving an automotive cooling fan or the like. In a first aspect, the motor system has two hydraulic drive mechanisms, circumferentially fixed to a common shaft and surrounded by a common, fluid-tight chamber, In this first aspect, the hydraulic drive mechanisms preferably are gerotor sets, each comprising an inner rotor, circumferentially fixed to the common shaft, and an outer rotor eccentrically positioned about the inner rotor. The fluid-tight chamber is established by securing an end frame can against the perimeter of a manifold cavity. The two gerotor sets are stacked on opposite sides of a center plate, one gerotor set being placed in the manifold cavity, and the center plate and other gerotor set being placed in the can.

In a second aspect, the invention provides an improved method of preventing leakage of hydraulic fluid from a dual drive hydraulic motor system. The method involves the steps of:

(1) stacking the hydraulic motor components against a manifold, (2) placing a sealing ring around the hydraulic motor components and in contact with the manifold, (3) moving an end frame can enclosingly about the hydraulic motor components and into contact with the sealing ring, (4) urging a resilient cover plate toward the end frame can from a position opposite the manifold, and (5) adjustably clamping the resilient cover against said manifold until the resilient cover has undergone a predetermined amount of elastic deformation.

It is therefore an object of the invention to provide an improved dual displacement hydraulic motor system which is more simple to manufacture and easier to maintain.

It is another object of the invention to provide an improved method of assembling a hydraulic motor system.

Other and further objects and advantages of the invention will be apparent from the following specification, with its appended claims, and the attached drawings.

DESCRIPTION OF THE PREFERRED EMBODIMENTS

Figure 2:
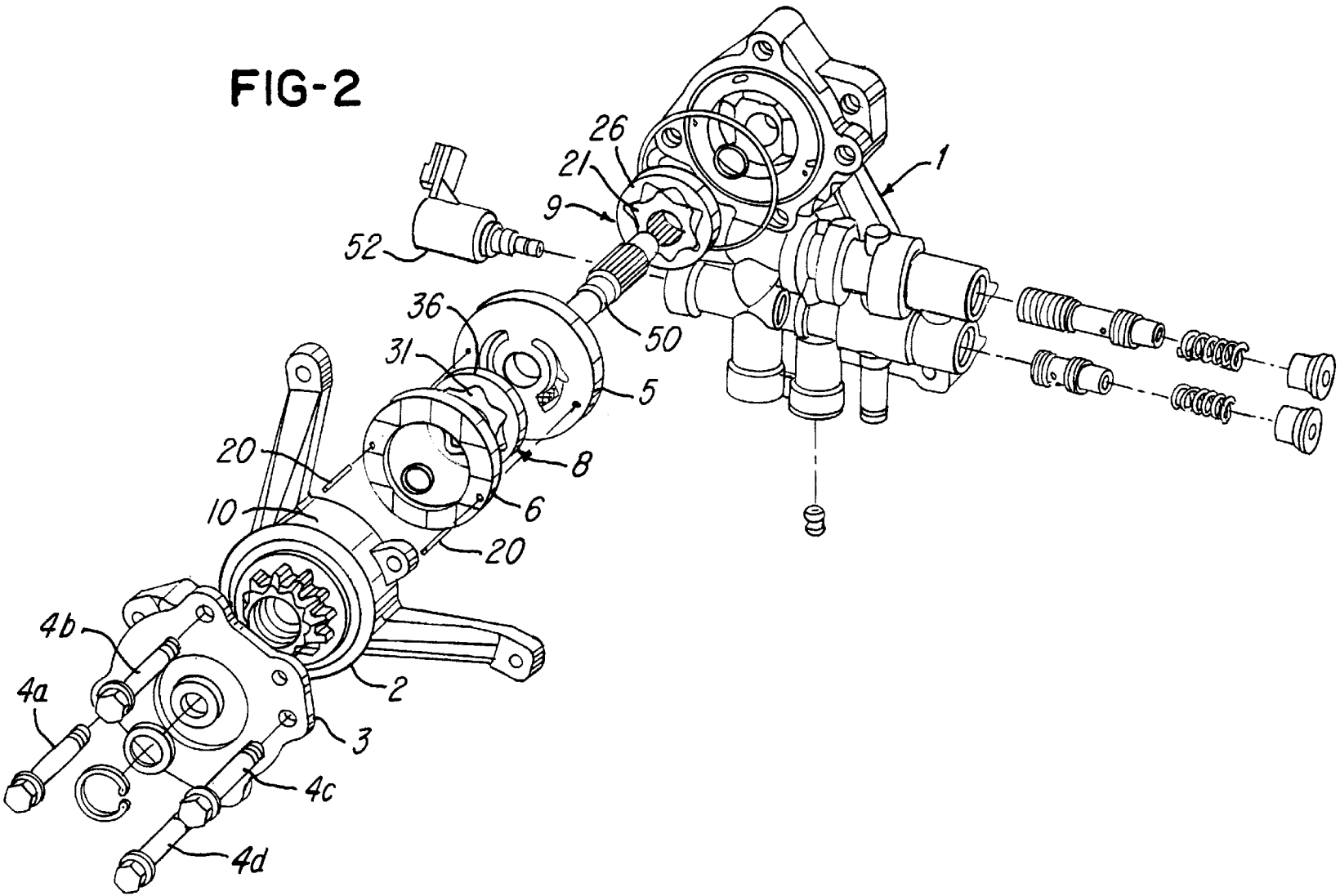
FIG. 2 is an exploded perspective drawing of a hydraulic motor system according to the present invention.

The improved hydraulic motor system is illustrated in the exploded perspective drawing of FIG. 2 shown therein are a manifold 1, an end frame 2 and a cover plate 3. Four threaded bolts 4*a–d,* preferably of the MIO type, extend through cover plate 3 and engage manifold 1 to clamp end frame 2 therebetween. A shaft 50 extends from manifold 1 through end frame 2 and cover plate 3 for engagement with an automotive cooling fan (not illustrated). An idle gerotor set 8, comprising inner and outer idle rotors 31, 36, respectively, is stacked on shaft 50 inside a circular opening 53 in eccentric ring 6. Idle gerotor set 8 is stacked between end frame 2 and a center plate 5. Also, a grade gerotor set 9, comprising inner and outer grade rotors 21, 26, respectively, is stacked on shaft 50 between center plate 5 and manifold 1. Outer grade rotor 26 is received within a cylindrical cavity 51 in manifold 1, as illustrated on FIG. 3. Inner grade rotor 21 and inner idle rotor 31 are circumferentially fixed to shaft 50 by axially extending rectangular teeth. Circular opening 53 and cylindrical cavity 51 are positioned eccentrically with respect to the axis of shaft 50. Alignment is maintained between the above-described parts by means of a pair of alignment pins 20, 20 extending parallel to shaft 50.

Note also that when end frame 2 is positioned on manifold 1, the pins 20 eccentrically align ring 6, center plate 5 and manifold 1, thereby reducing human errors and facilitating reduction of assembly time.

Figure 1:
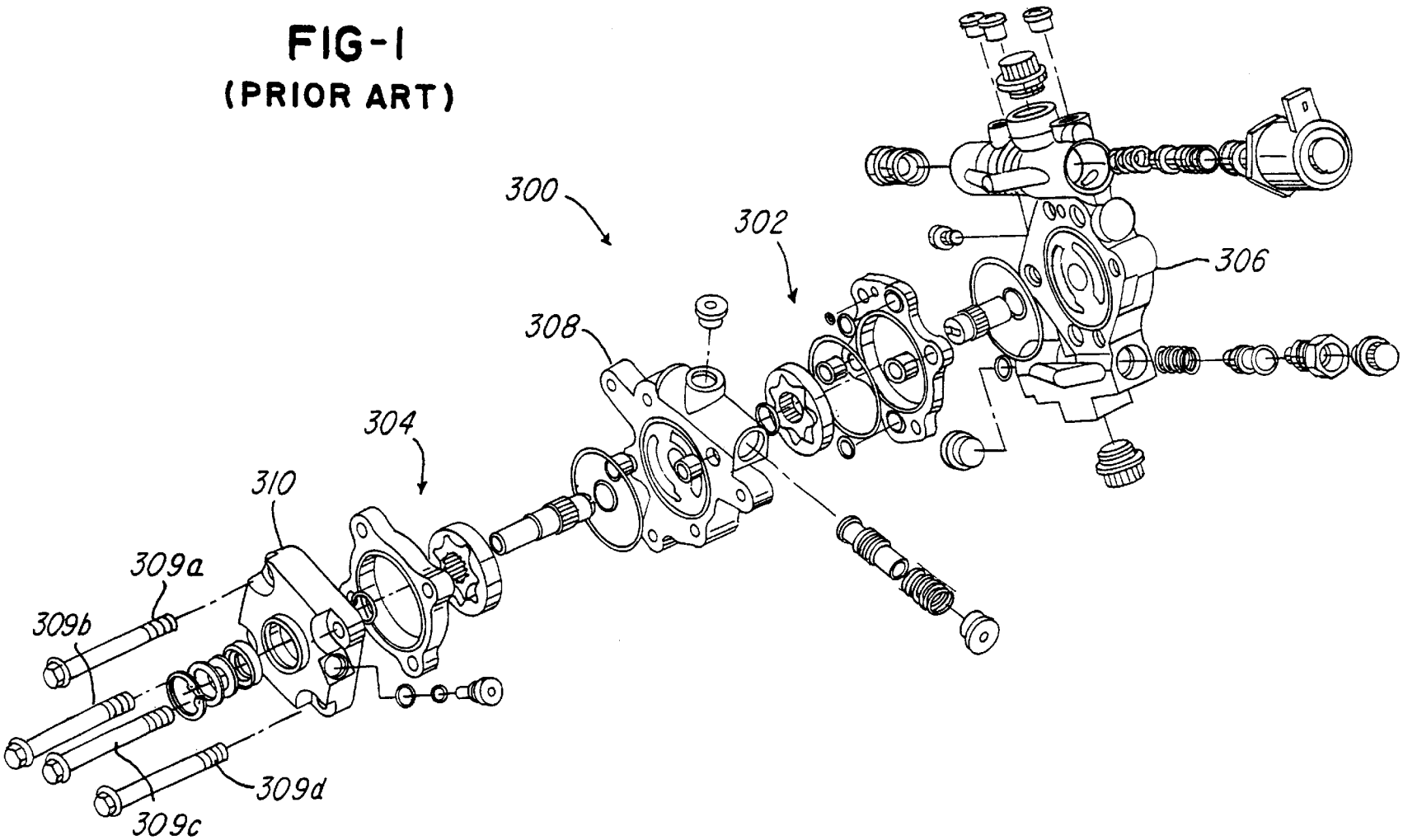
FIG-1 (PRIOR ART)
FIG. 1 is an exploded perspective drawing of a prior art hydraulic motor system.
Figure 3:
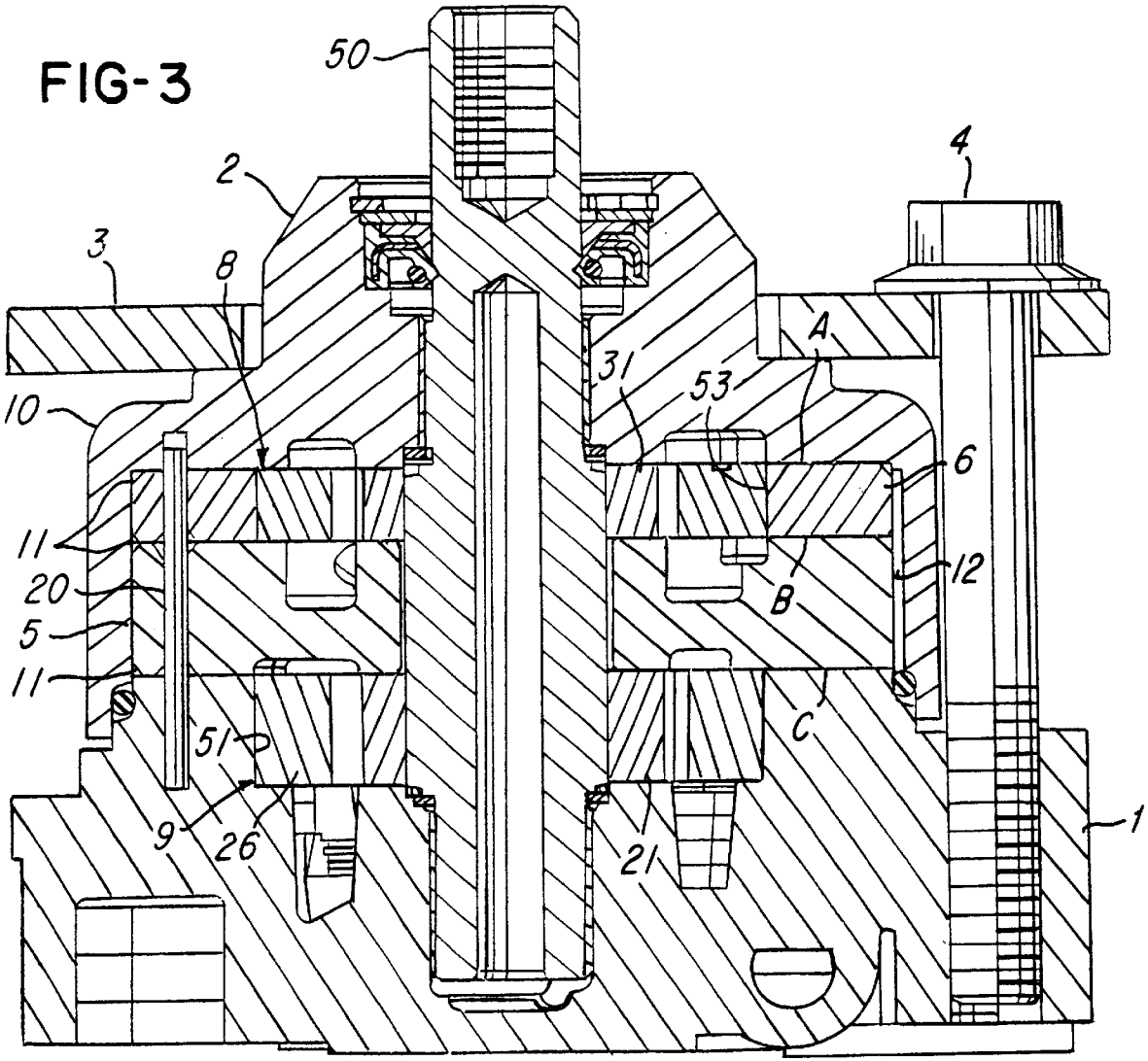
FIG. 3 is a side elevation drawing of the hydraulic motor system, sectioned to show an axially extending hydraulic fluid return channel in a side wall of a can.
Figure 4:
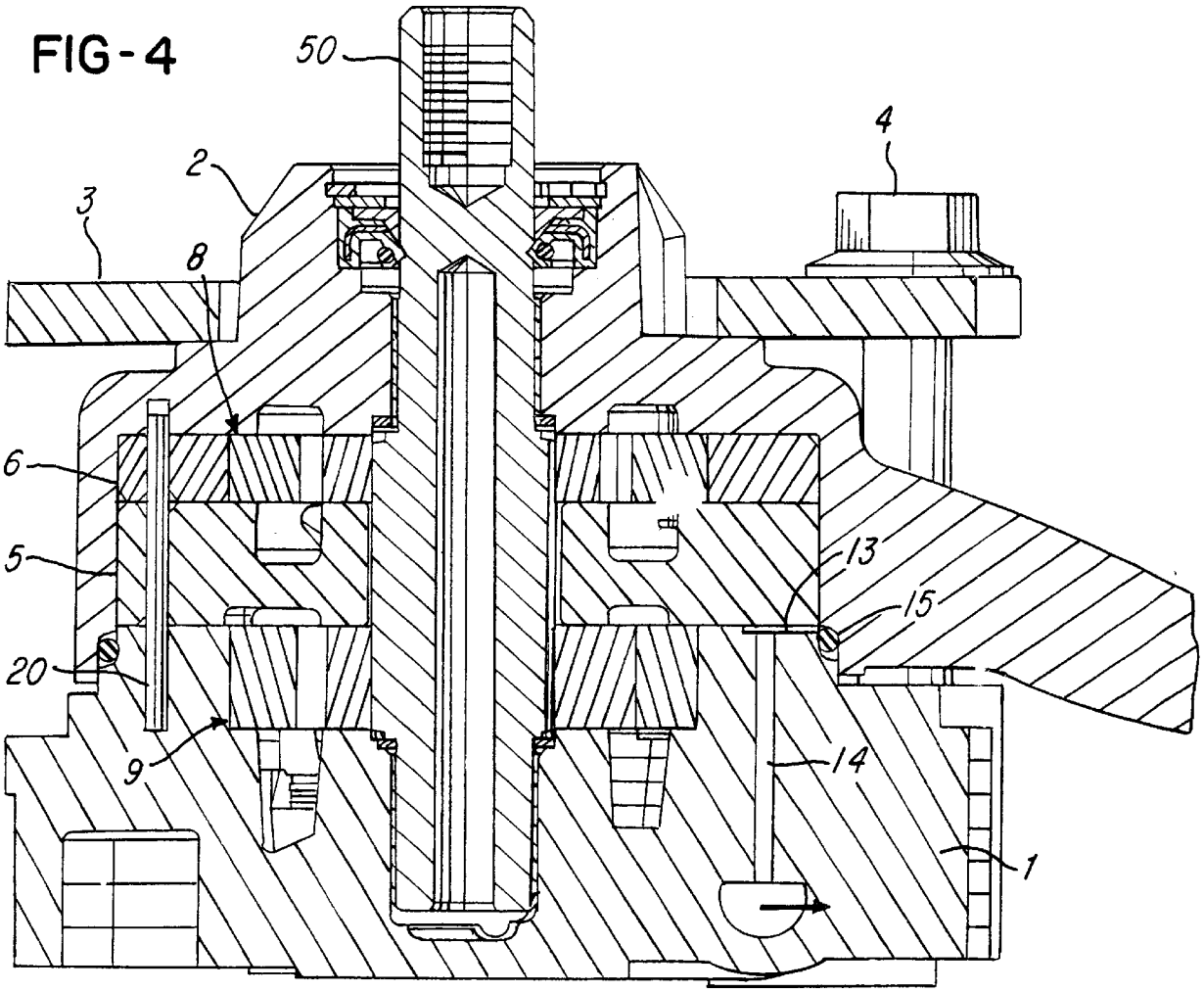
FIG. 4 is a side elevation drawing of the hydraulic motor system, sectioned to show an enclosed, axially extending, hydraulic fluid return passage and a radially extending notch which feeds hydraulic fluid thereto.
Figure 6:
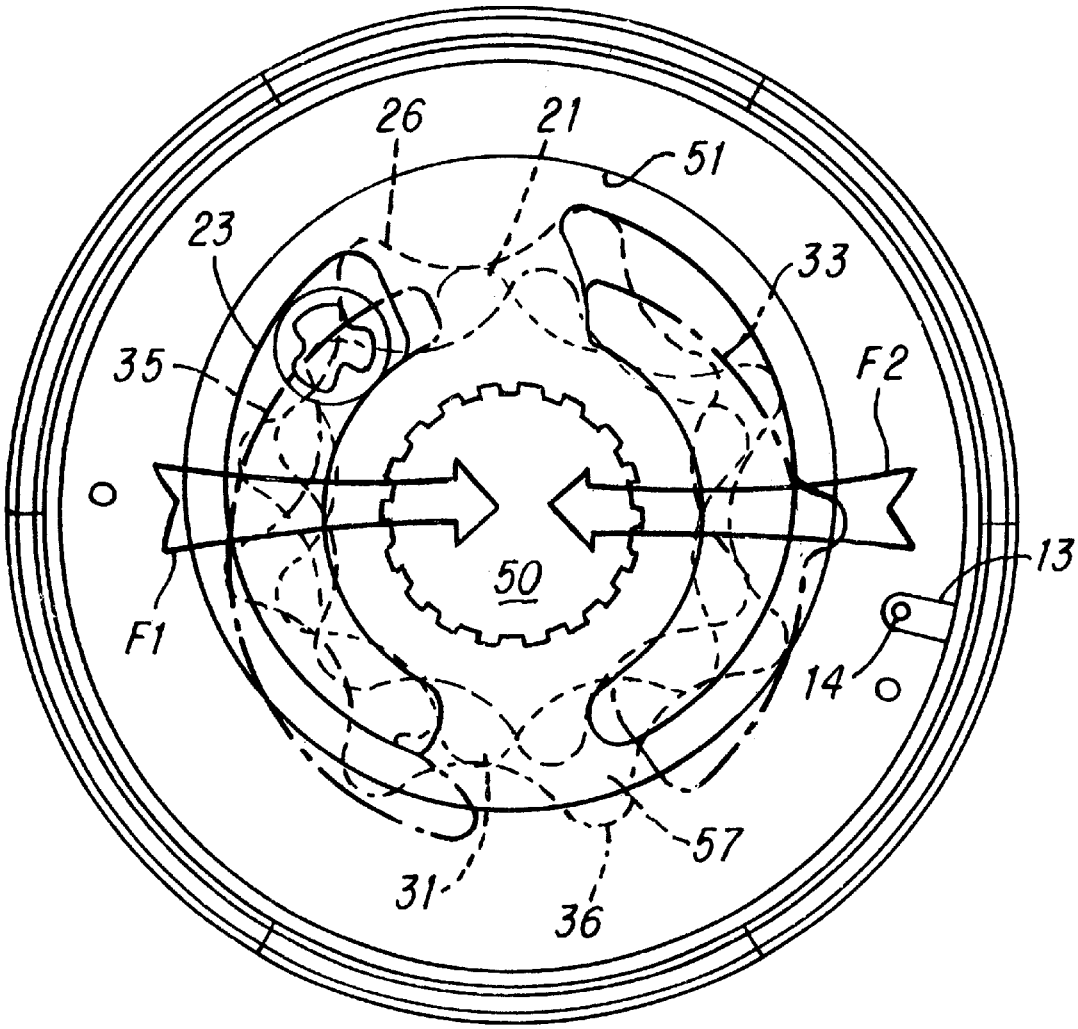
FIG. 6 is a schematic illustration of an offset cylindrical cavity in a front face of a manifold.
Figure 7:
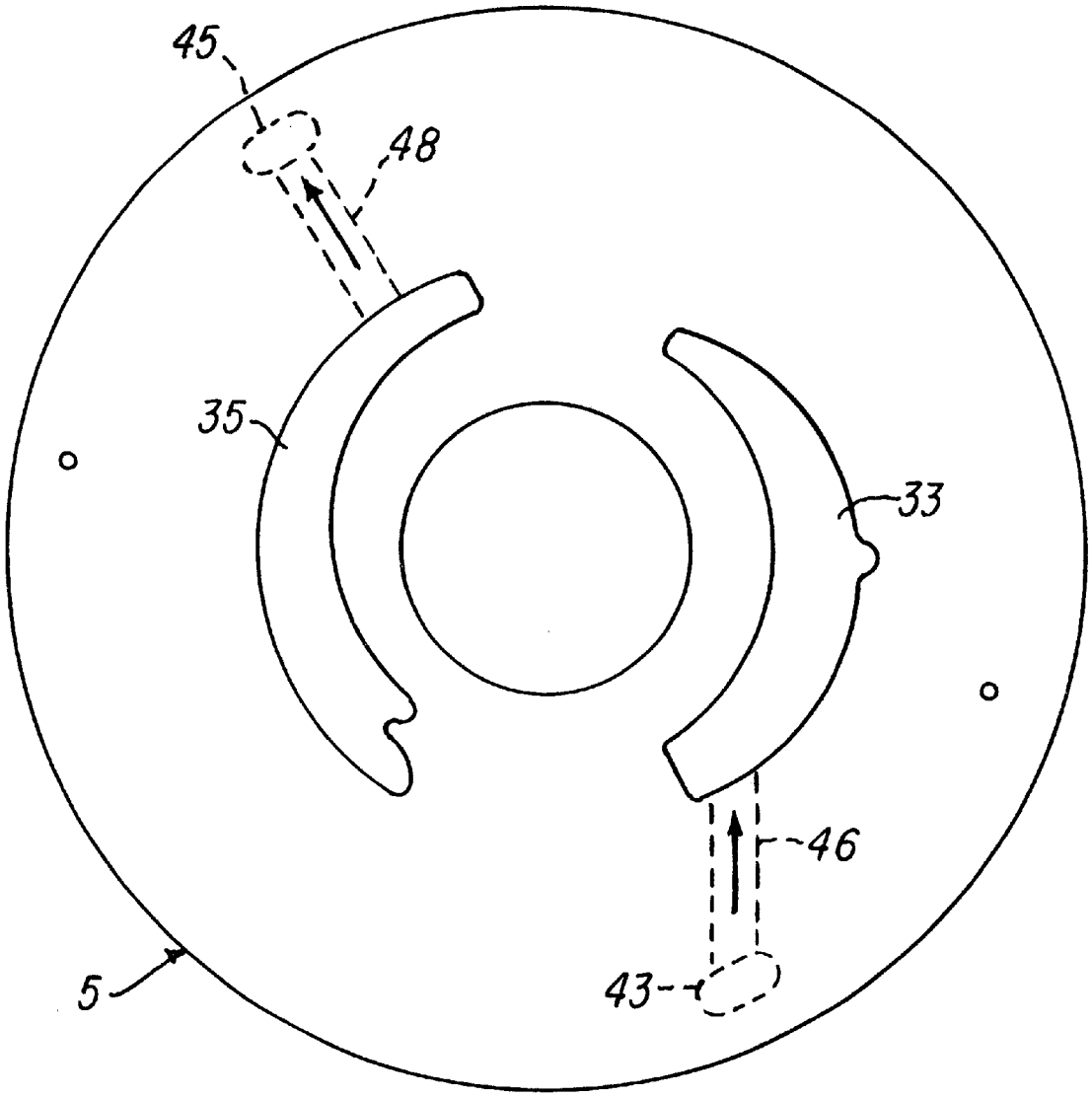
FIG. 7 is an illustration of a center plate.
Figure 8:
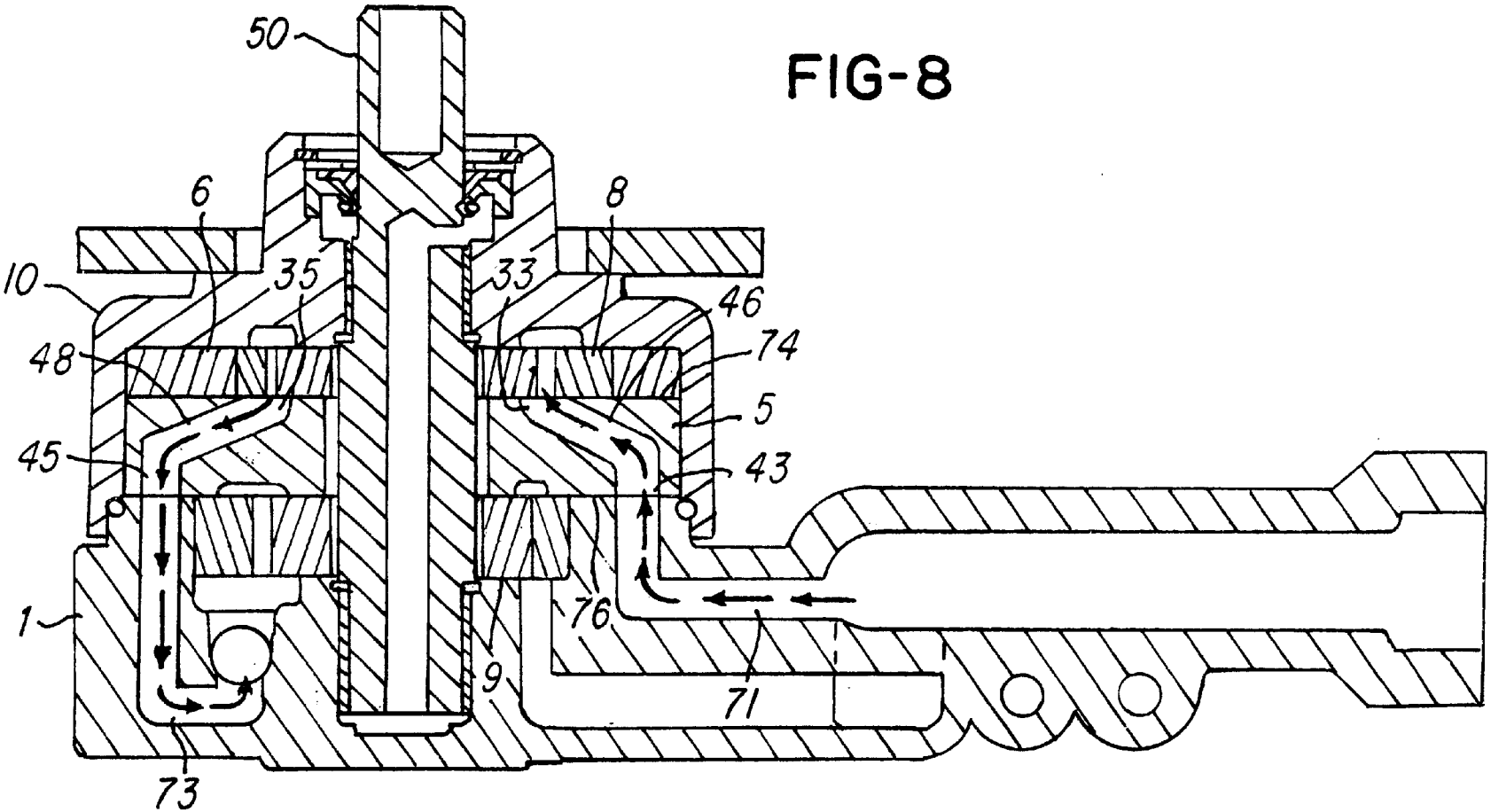
FIG. 8 is a side elevation drawing of the hydraulic motor system, sectioned to show a path for conveying hydraulic fluid between a manifold and an idle gerotor set.

Numerous interface seals required by the prior art configuration of FIG. 1 are eliminated through use of the metal to metal stack construction as shown in FIGS. 2 and 3. In the present invention, clamped surfaces at interface A (between end frame 2 and eccentric ring 6), interface B (between eccentric ring 6 and center plate 5) and interface C (between center plate 5 and manifold body 1) define the principle fluid boundaries to enclosed operation pockets for gerotor sets 8 and 9. (Details on the passage of oil through the stacked plate interfaces to the two gerotor sets are shown in FIGS. 6–8). Leakage past the interfaces is captured by an overall cylindrical can 10 integral to end frame 2. This leakage hydraulic fluid is collected within the can and channeled radially through grooves created by chamfers 11 on center plate 5 and eccentric ring 6. and further on to axial channel 12 in the interior wall of can 10. Leakage hydraulic fluid is then carried out of the general motor area and vented to near atmospheric pressure through notch 13 (FIG. 4) on the face of manifold 1 and passage 14 as shown on FIG. 4. Given that the restriction to hydraulic fluid flow through interfaces A, B and C is considerably tighter than through notch 13 and passage 14 the pressure within the can 10 is low. Thus, multiple high pressure seals required in the prior art are replaced by one low pressure seal 15 in this invention.

Figure 5:
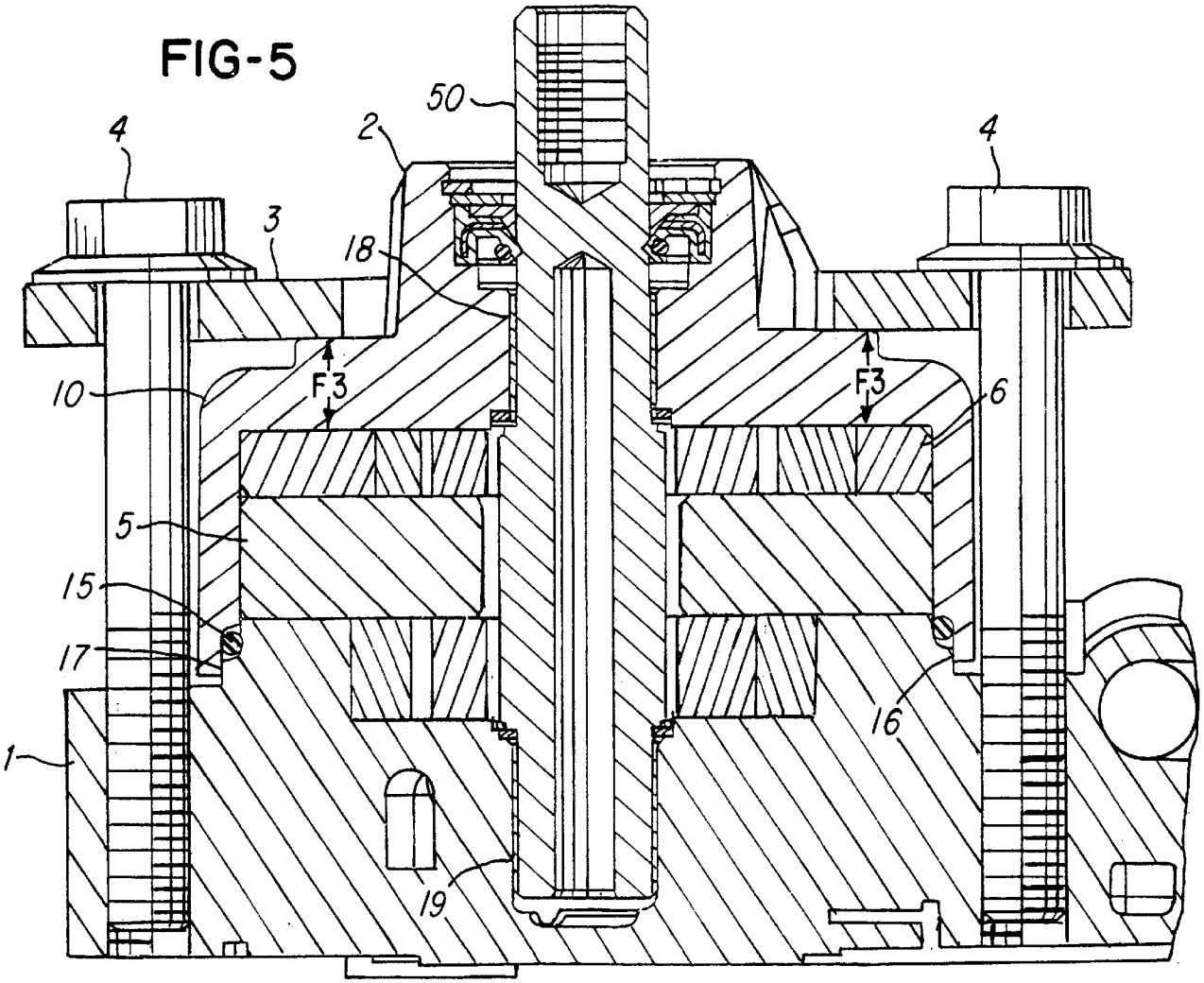
FIG. 5 is a side elevation drawing of the hydraulic motor system, sectioned to illustrate clamping of a cover plate.

Requirements for traditional dowels in the construction are eliminated by dividing the alignment feature provided by close tolerance dowels into two functions. Referring now to FIG. 5, the can 10 which is an extension of end frame 2 provides centerline to centerline alignment to eccentric ring 6 and center plate 5. Further, the interface ID 16 allows alignment through interface OD 17 on manifold 1. These features facilitate the alignment of bearings 18 and 19 on shaft 50, given that proper tolerances have been established and maintained.

Referring again to FIG. 3, one alignment pin 20 feeds through all parts as shown to provide proper angular alignment for port timing to the two gerotor sets. The second alignment pin 20 (shown on FIG. 2) is used on the remote side of the motor stack to better balance and provide initial alignment prior to the introduction of can 10 during assembly. In this manner, both the centerline alignment and angular positioning of parts may be accomplished without traditional multiple tight tolerance dowels between each interface of the hydraulic stack.

FIG. 6 shows cylindrical cavity 51, as viewed from interface C, with end frame 2, idle gerotor set 8 and center plate 5 being removed. The figure shows kidney-shaped inlet and outlet ports 23, 25 respectively for circulating hydraulic fluid through grade gerotor set 9. High pressure hydraulic fluid is admitted from inlet port 23 to grade gerotor set 9 between inner grade rotor 21 and outer grade rotor 26. Projections of inner grade rotor 21 and outer grade rotor 26 are indicated by dotted lines on FIG. 6. Projections of inner and outer idle rotors 31, 36, respectively are also shown in dotted lines. Projections of inlet and outlet ports 33, 35 respectively for circulating hydraulic fluid through idle gerotor set 8, are indicated in phantom lines.

Outer rotors 26, 36 each have one more tooth than their associated inner rotors 21, 31 respectively. This plus the eccentric positioning of outer rotors 26, 36 causes an outer rotor sliding action which creates continuously opening and closing pockets 57 at each outer rotor tooth, as the gerotor pairs rotate. For each complete rotation of an outer rotor, the pocket 57 at each outer rotor tooth progresses through a cycle between fully opened and substantially closed conditions. The pockets generally increase in size while overlapping an inlet port and decrease in size while overlapping an outlet port.

As hydraulic fluid fills the space between inner and outer grade rotors 21, 26 all pockets 57 which overlap inlet port 23 rise to high pressure, and grade gerotor set 9 rotates CW (when viewed in an axially rearward direction looking from end frame 2 toward manifold 1, as in FIG. 6). All pockets 57 which overlap outlet port 35 are at low pressure. When taken in aggregate, this creates a large force imbalance bearing force F1 on the inner grade rotor, as shown. This force is transferred to shaft 50 resulting in deflection and frictional loads at bearings 18, 19 (FIG. 5). However, the fluid flow direction is reversed for idle gerotor set 8. This produces an oppositely acting bearing force F2. The two resultant shaft loads oppose each other greatly reducing shaft deflection and net bearing load. The fluid flow through idle gerotor set 8 also produces a net CW torque on shaft 50, even though the radial force F2 is opposite F1. This is due to the fact that outer grade rotor 26 and outer idle rotor 36 are radially offset in opposite directions from the axis of shaft 50.

A solenoid 52 (FIG. 2) controls the flow of hydraulic fluid to gerotor sets 8 and 9. The timing of the flow sequence to gerotor sets 8 and 9 may be in accordance with the teachings of Buschur U.S. Pat. No. 5,561,978, which is incorporated herein and made a part hereof. The connections to grade gerotor set 9 run more or less directly to ports 23, 25. FIGS. 7 and 8 show the connections to idle gerotor set 8. FIG. 7 is a view of the front face 74 of plate 5. That figure shows the inlet and outlet ports 33 and 35 respectively for idle gerotor set 8. Hydraulic fluid flows to inlet port 33 via an internal supply passage 46 connected to an opening 43 on the rear face 76 of center plate 5. Upon entry into inlet port 33, the hydraulic fluid causes CW rotation of gerotor set 8, meanwhile undergoing pocketed flow from inlet port 33 to outlet port 35. Thereafter, the flow path through center plate 5 is via an internal passage 48 to a rear face opening 45.

FIG. 8 is a sectioned side elevation view of an assembled hydraulic motor system, according to the present invention. Shown there are passages 71 and 73 in manifold 1. Passages 71, 73 are in communication with openings 43, 45. This completes the flow path between manifold 1 and idle gerotor set 8.

Referring again to FIG. 5, attention is directed at cover plate 3. This element should be fabricated from a resilient material. Any one of a wide range of materials would be suitable, but ferrous stock is preferred due to its relatively low cost and its temperature insensitive modulus of elasticity. Cover 3 has two important functions.

First, cover 3 serves as a massive wave washer allowing a predictable axial clamping load to be applied to the motor stack to resist pressure forces and prevent leakage at the stack interfaces. During assembly, a relatively light torque load (<10 N-m) is applied to each of bolts 4*a*–4*d* to seat the cover plate in a starting position. Then each bolt is turned a set number of degrees, thereby deflecting the cover plate. This applies a predetermined clamping pressure to interfaces A, B, and C (FIG. 3). The only significant variables thus determining the resultant clamping load are the thickness and modulus of the plate and pitch of the bolt threads, all of which are highly controllable. Given that the cover plate is not a perfect washer shape due to packaging issues, the drive angles of the four bolts are modified to allow a uniform clamping load around the clamp load circle. Significant deflection of the plate is desirable as it then easily compensates for any long term creep of the threads.

The second design function of cover plate 3 is to allow manipulation of the location of the resultant clamping loads on the motor stack caused by the bolt tensile loads. It is apparent that bolts 4*a*–4*d* must be placed outside the seal perimeter as defined by seal 15 resulting in clamping loads outside the desired clamp load circle and increasing the diameter of the disk which hydraulic loads can attempt to deflect. However, cover plate 3 transfers the loads generated by the bolts to a circular area inside the arrows F3, thereby minimizing bending moments applied to the stacked motor elements.

While the form of apparatus and the method herein described constitute preferred embodiments of the invention, it is to be understood that the invention is not limited to these precise forms of apparatus and method, and that changes may be made therein without departing from the scope of the invention which is defined in the appended claims.

What is claimed is:

1. The hydraulic motor system comprising:

a shaft situated on a manifold;

a first hydraulic drive mechanism mounted in driving relationship with said shaft;

a second hydraulic drive mechanism mounted in driving relationship with said shaft;

a cover mounted on said manifold to define a common fluid-tight environment in which said first and second drive hydraulic mechanisms are located; said shaft extending through an opening in said cover and the cover also mounted on said manifold; and at least one seal situated between said cover and said manifold; and a center plate, said center plate and said gerotor sets being stacked on said shaft in face-to-face relationship.

2. The hydraulic motor system according to claim 1 wherein said center plate is stacked between said gerotor sets.

3. The hydraulic motor system comprising:

a shaft situated on a manifold;

a first hydraulic drive mechanism mounted in driving relationship with said shaft;

a second hydraulic drive mechanism mounted in driving relationship with said shaft;

a cover mounted on said manifold to define a common fluid-tight environment in which said first and second drive hydraulic mechanisms are located; said shaft extending through an opening in said cover and the cover also mounted on said manifold; and at least one seal situated between said cover and said manifold; and said hydraulic motor system, further comprisingan end frame and a plurality of bolts, said bolts joining said end frame to said cover to said manifold and clamping said gerotor sets and said center plate therebetween.

4. The hydraulic motor according to claim 3 wherein said bolts are adjustable for controlling interface pressure within said hydraulic motor system.

5. The hydraulic motor system according to claim 3 wherein at least one of said plurality of bolts secures said gerotor sets to said manifold.

6. The hydraulic motor system according to claim 5 wherein said first and second hydraulic drive mechanisms each comprise a gerotor set, including an inner rotor and an outer rotor.

7. The hydraulic motor system according to claim 5 wherein a center plate is stretched between said first and second hydraulic drive mechanisms, said plurality of bolts joining said center plate and said first and second hydraulic drive mechanisms.

8. The hydraulic motor system according to claim 5 wherein said system further comprises a gasket mounted between said cover and manifold.

9. An hydraulic motor system comprising:

(a) a shaft;

(b) a first inner rotor mounted on said shaft;

(c) a first outer rotor mounted on said shaft radially surrounding said first inner rotor;

(d) an eccentric ring mounted on said shaft radially surrounding said first outer rotor;

(e) a center plate stacked on said shaft in face-to-face contact with said first inner rotor; said first outer rotor and said eccentric ring;

(e) a second inner rotor stacked on said shaft in face-to-face contact against said center plate, opposite said first inner rotor;

(f) a second outer rotor stacked on said shaft radially surrounding said second inner rotor and in face-to-face contact against said center plate;

(g) a manifold supportingly receiving said shaft and being in fluidic communication with said second inner rotor and said second outer rotor;

(h) a can mounted fast on said manifold so as to receive said shaft and sealingly enclose said first and second inner and outer rotors, said eccentric plate and said center plate while maintaining axial alignment therebetween; and (i) a pin received and positioned for maintaining circumferential alignment between said can, said eccentric plate, said center plate and said manifold.

10. A hydraulic motor system according to claim 9 further comprising a second pin circumferentially disposed with respect to said first mentioned pin to facilitate initial alignment of elements comprising said hydraulic motor system.

11. A hydraulic motor system according to claim 10 wherein said first inner and outer rotors define a first gerotor pair, and said second inner and outer rotors define a second gerotor pair.

12. An hydraulic motor system comprising:

(a) a shaft;

(b) a first inner rotor mounted on said shaft;

(c) a first outer rotor mounted on said shaft radially surrounding said first inner rotor;

(d) an eccentric ring mounted on said shaft radially surrounding said first outer rotor;

(e) a center plate stacked on said shaft in face-to-face contact with said first inner rotor; said first outer rotor and said eccentric ring;

(e) a second inner rotor stacked on said shaft in face-to-face contact against said center plate, opposite said first inner rotor;

(f) a second outer rotor stacked on said shaft radially surrounding said second inner rotor and in face-to-face contact against said center plate;

(g) a manifold supportingly receiving said shaft and being in fluidic communication with said second inner rotor and said second outer rotor;

(h) a can mounted fast on said manifold and enclosing said first and second inner and outer rotors, said eccentric plate and said center plate; and (i) a flexible seal interposed between said can and said manifold.

13. An hydraulic motor system according to claim 23 wherein all areas of said face-to-face contact are substantially resistant to fluid flow in a radial direction, said hydraulic motor system being provided with passageways interiorly connecting said flexible seal to a source of relief at atmospheric pressure.

14. The system according to claim 13 wherein said relatively light load is less than about 10 newton meters.

* * * * *